US010888145B2

(12) United States Patent
Kukreja

(10) Patent No.: US 10,888,145 B2
(45) Date of Patent: Jan. 12, 2021

(54) COSMETIC APPLICATOR

(71) Applicant: Toly Management Ltd., Zejtun ZTN (MT)

(72) Inventor: Shipra Kukreja, New Dehli (IN)

(73) Assignee: Toly Management Ltd., Zejtun (MT)

( * ) Notice: Subject to any disclaimer, the term of this patent is extended or adjusted under 35 U.S.C. 154(b) by 277 days.

(21) Appl. No.: 15/943,583

(22) Filed: Apr. 2, 2018

(65) Prior Publication Data

US 2018/0279740 A1 Oct. 4, 2018

(30) Foreign Application Priority Data

Apr. 4, 2017 (IN) ..... 201711012130

(51) Int. Cl.
*A45D 34/04* (2006.01)
*A45D 40/26* (2006.01)

(52) U.S. Cl.
CPC ..... *A45D 34/046* (2013.01); *A45D 34/043* (2013.01); *A45D 40/264* (2013.01); *A45D 40/267* (2013.01); *A45D 2200/1036* (2013.01)

(58) Field of Classification Search
CPC .... A45D 34/042; A45D 34/00; A45D 34/041; A45D 34/045; A45D 34/046; A45D 34/06; A45D 40/264; A45D 40/261; A45D 40/262; A45D 40/265; A45D 40/267; A45D 34/047; A45D 2200/1036; A45D 2200/10; A45D 2200/1009; A61F 13/38
USPC .... 15/106, 108; 401/126, 128, 129, 130, 22, 401/23, 24, 37
See application file for complete search history.

(56) References Cited

U.S. PATENT DOCUMENTS 8,726,913 B2 * 5/2014 Weigel ..... A45D 40/265 132/218
8,783,268 B2 * 7/2014 Gueret ..... A45D 40/265 132/218
10,172,435 B2 1/2019 Pires et al.
2007/0062552 A1 * 3/2007 De Brouwer ..... A45D 34/045 132/218
2007/0181143 A1 * 8/2007 Montoli ..... A45D 34/04 132/320
2011/0297174 A1 * 12/2011 Ornoski ..... A45D 40/265 132/218

FOREIGN PATENT DOCUMENTS

DE 202016103629 7/2016

* cited by examiner

*Primary Examiner* — Rachel R Steitz
*Assistant Examiner* — Karim Asqiriba
(74) *Attorney, Agent, or Firm* — Wissing Miller LLP

(57) ABSTRACT

A cosmetic applicator comprises an applicator head for applying a product including a cosmetic or a care product. The applicator head comprises a first applicator member and a second applicator member. The first applicator member is cylindrical in shape and has a cavity extending throughout a length of the first applicator member. The second applicator member is received within the cavity of the first applicator member. A portion of an outer surface of the first applicator member includes a first application surface having a plurality of application elements and a distal end surface of the second applicator member includes a second application surface for applying the product in onto human skin or keratinous fibers.

20 Claims, 7 Drawing Sheets

COSMETIC APPLICATOR

TECHNICAL FIELD

Embodiments of the present disclosure generally relate to a cosmetic applicator for applying a product including a cosmetic, care or pharmaceutical product onto human skin or keratinous fibers, such as, for example, hair, eyebrows, nails and/or eyelashes. The product includes viscous liquid, semisolid or powder product.

BACKGROUND

Cosmetic applicators such as dip or wand applicators are known in the cosmetic industry. Cosmetic packages often include such applicators for dispensing a particular cosmetic contained in the package reservoir. The cosmetic applicator generally includes a stem with a cap at one end and an applicator head in the form of a brush, spatula or other applicator structure suitable for applying a cosmetic or a care product including viscous cosmetics, mascara, eye liner, lip gloss, hair color, wound care, skin care, under eye cosmetics, pharmaceutical and like products.

One such applicator is disclosed in U.S. Pat. No. 6,331,085 B1 for applying and transporting a quantity of cosmetic product to a user's skin. The applicator comprises a generally cylindrical elastomeric tip with a long axis, the tip including a distal end portion having a distal extremity with at least one material-holding concavity formed therein, and said concavity having a rim.

Another U.S. Pat. No. 7,481,591 discloses an applicator comprising a rod and an application surface formed of a plurality of cones. These cones have a certain elasticity and movability and can therefore massage the cosmetic product, which is stored between them into wrinkles and uneven areas of the skin of a user.

While such applicators are generally satisfactory, there still exists a need for an applicator for applying a cosmetic product to human keratin materials.

SUMMARY

According to an embodiment of the present disclosure, there is provided a cosmetic package comprising a cosmetic applicator for applying a product including a cosmetic or a care product. The cosmetic or care product includes viscous cosmetics, such as mascara, eyebrow powder/stain, lip gloss, hair color, skin care, under eye cosmetics, pharmaceutical and like products.

According to an embodiment of the present disclosure, the applicator comprises an applicator head retained at a distal end of a stem for applying the product; and a cap at a proximal end of the stem.

According to an aspect of the present disclosure, the cosmetic package comprises a receptacle configured to contain the product and the cosmetic applicator. The applicator head is configured to be inserted into the receptacle so as to become loaded with the product and transport the product onto a surface where the product needs to be applied.

According to an aspect of the present disclosure, a wiper is inserted into a neck of the receptacle for wiping off excess product from the cosmetic applicator while the cosmetic applicator is being removed from the receptacle.

According to another aspect of the present disclosure, the cap of the cosmetic applicator has threads which can be screwed onto threads formed on the neck of the receptacle.

Other engagement means known in the art, can also be used to engage the cap with the receptacle.

According to yet another aspect of the present disclosure, the distal end of the stem includes an interior longitudinal cavity for receiving and retaining the applicator head.

According to yet another aspect of the present disclosure, the applicator head comprises a first applicator member and a second applicator member, and wherein the first applicator member is configured to receive and retain at least a portion of the second applicator member. The first applicator member has a cavity with an open proximal end and an open distal end. The cavity extends throughout a length of the first applicator member. At least a portion of the second applicator member is received within the cavity of the first applicator member.

A portion of an outer surface of the first applicator member includes a first application surface having a plurality of application elements and the second applicator member comprises a second application surface configured to load and transfer the product to a human keratinous material. In use, when the applicator head is withdrawn from the receptacle, the wiper cleans the applicator head in a manner such that an optimal amount of product is retained on the second application surface, and a minimal amount of product or substantially no product is retained on the plurality of application elements of the first application surface. Therefore, a user may use the second application surface to transfer the product on to human keratinous fibers and the plurality of application elements of the first application surface for defining human keratinous fibers such as eyebrows or eyelashes. In an exemplary use of the cosmetic applicator of the present disclosure, the applicator may be used for applying a product to eyebrows, and wherein the first application surface may be used for filling and shaping the eyebrows with the product and the applications elements of the second application surface may be used to sculpt and define the eyebrows.

According to yet another aspect of the present disclosure, the first applicator member and the second applicator member are molded applicator members.

According to yet another aspect of the present disclosure, the first applicator member is substantially cylindrical in shape and comprises a proximal portion and a distal portion. In alternate embodiments, however, the first applicator member may have any other desirable shape.

According to another aspect of the present embodiment, the first applicator member has a slanted opening at its distal end. More particularly, the cavity of the first applicator member has a substantially oval opening at the distal end of the first applicator member. In other words, the opening is oriented in a plane which is oblique with respect to a longitudinal axis of the applicator head. In variant embodiments, the opening may have any other desirable shape, as for example, spatulate, obovate, elliptic, oblong, deltoid etc.

According to yet another aspect of the present embodiment, the plurality of application elements are adapted to convey and apply the cosmetic product. In a preferred embodiment, the application elements are tines, however in variant embodiments, the application elements may be projections, bristles, tines, flocking, particles, ribs, grooves, discs, slits, cuts, holes, dimples, foam or other surface features or surface treatments (e.g., abrading) that are suitable for loading, transporting and applying the cosmetic product such as, for example, mascara or eyebrow stain/powder.

According to another aspect of the present disclosure, the tines can be arranged in rows, preferably at a constant spacing within one and the same row.

According to another aspect of the present disclosure, the plurality of application elements is spread over at least 40% of an outer surface area of the distal portion of the first applicator member.

According to another aspect of the present disclosure, the proximal portion of the first applicator member is formed as a shank which is configured to be received within the cavity of the stem.

According to an embodiment of the present disclosure, a diameter of the shank is less than a diameter of the distal portion of the first applicator member.

According to an embodiment of the present disclosure, the second applicator member is an elongated rod like structure having a proximal end and a distal end. The distal portion of the second applicator member includes a slanted distal end surface which is convexly curved, and is configured to apply/spread the product on user's skin. The slanted distal end surface forms the second application surface. The slanted distal end surface means the distal end surface is oriented in a plane which is oblique with respect to a longitudinal axis of the applicator head. In alternate embodiments, the distal end surface of the second applicator may not be slanted or curved.

According to yet another aspect of the present disclosure, at least a portion of the second application surface is opposite to the first application surface.

According to yet another aspect of the present embodiment, when the second applicator member is received within the cavity of the first applicator member, the second application surface projects or extends out from the opening of the cavity at the distal end of the first applicator member. In variant embodiments, however, the second application surface may flush with the distal end of the first applicator member.

According to yet another aspect of the present embodiment, the second application surface may comprise projections, flocking, ribs, grooves, other surface features or surface treatments (e.g., abrading) that are suitable for loading, transporting and applying the cosmetic product. The second applicator member may be made of a material capable of retaining a fluid or semi-solid cosmetic product, the material for e.g. may be an absorbent material such as sponge, foam, woven or non-woven material or any porous material including sintered materials.

According to yet another aspect of the present embodiment, the second applicator member can be retained within the cavity of the first applicator member, by locking means known in the art such as a j-lock, a threaded engagement, an interference engagement, magnetic engagement or the like. In a preferred embodiment, the first applicator member and the second applicator member are secured to each other by snap-fitment. The first applicator member includes an annular projection on its inner surface and the second applicator member includes an annular recess and an annular flange above said annular recess. When the applicator head is assembled, a proximal portion of the second applicator member is inserted into the cavity of the first applicator member through the distal end of the first applicator member, the annular projection of the first applicator member is snap fitted into the corresponding annular recess of the second applicator member, and thereby further insertion of the second applicator member with respect to the first applicator member is limited. Further, the flange of the second applicator member is locked against the annular projection making removal of the second applicator member difficult. In an alternate embodiment, however, the annular projection may be on the second applicator member in which case, the annular recess is on the first applicator member.

According to an aspect of the present disclosure, there are provided complimentary orientation features on the inner surface of the first applicator member and an outer surface of the second applicator member to orient the second applicator member with respect to the first applicator member in a predetermined desirable position. Preferably, the second applicator member is so oriented that an apex of the second applicator member is always in line with an apex of the first applicator member.

According to an embodiment of the present disclosure, an orientation feature such as a longitudinal groove is provided on the outer surface of the second applicator member and a complimentary orientation feature which is a longitudinal protrusion is provided on the inner surface of the first applicator member and inside the cavity of the first applicator member. When the second applicator member is inserted into the cavity of the first applicator member, the protrusion fits into the longitudinal groove so as to align the first applicator member and the second applicator member in a predetermined desirable position. Preferably, the second applicator member is so oriented that an apex of the second applicator member is always in line with an apex of the first applicator member.

According to yet another aspect of the present embodiment, the applicator head and the stem may be fit together by friction fit, snap fit, by gluing, crimping, magnetic engagement and the like. In an exemplary embodiment, the applicator head and the stem are fitted together by snap fitment. The shank of the first applicator member includes at least one annular recess and the inner surface of the stem cavity includes corresponding annular bead. When the proximal portion or the shank of the applicator head is inserted into the interior longitudinal cavity of the stem, the at least one annular bead is snap-fitted into a corresponding annular recess.

According to an alternate embodiment of the present disclosure, at least a portion of one of the first application surface and the second application surface is covered by a flock coating.

According to an alternate embodiment of the present disclosure, at least one of the application elements is covered by a flock coating.

According to an embodiment of the present disclosure, material used for making the applicator head can be selected from a group consisting of plastic, metal, alloy, ceramic, stone, wood, rubber, absorbent materials and the like.

According to an embodiment of the present disclosure, the first applicator member is fabricated from a material selected from a group consisting of plastic, metal, alloy, ceramic, stone, wood, rubber, sintered or porous material and/or combinations thereof.

According to an embodiment of the present disclosure, the second applicator member is fabricated from a material selected from a group consisting of plastic, metal, alloy, ceramic, stone, wood, rubber, sintered or porous material and/or combinations thereof.

Receptacle could be formed of polypropylene while the cap and the stem could be formed of acrylonitrile butadiene styrene or any other suitable polymeric material. The stem may be formed of polyacetal or any other suitable polymeric material.

The material for forming the wiper could be low-density polyethylene, foam, sponge, sintered block, aggregate of natural or synthetic fibers, woven or non-woven fibers, plastic, or a combination of such materials. The aforementioned materials for forming various parts of the package of the present disclosure are an example, however other suitable materials may also be used.

The above and other objects, features and advantages of the present disclosure will become clear from the following description of the preferred embodiments when the same is read in conjunction with the accompanying drawings.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings.

Figure 1:
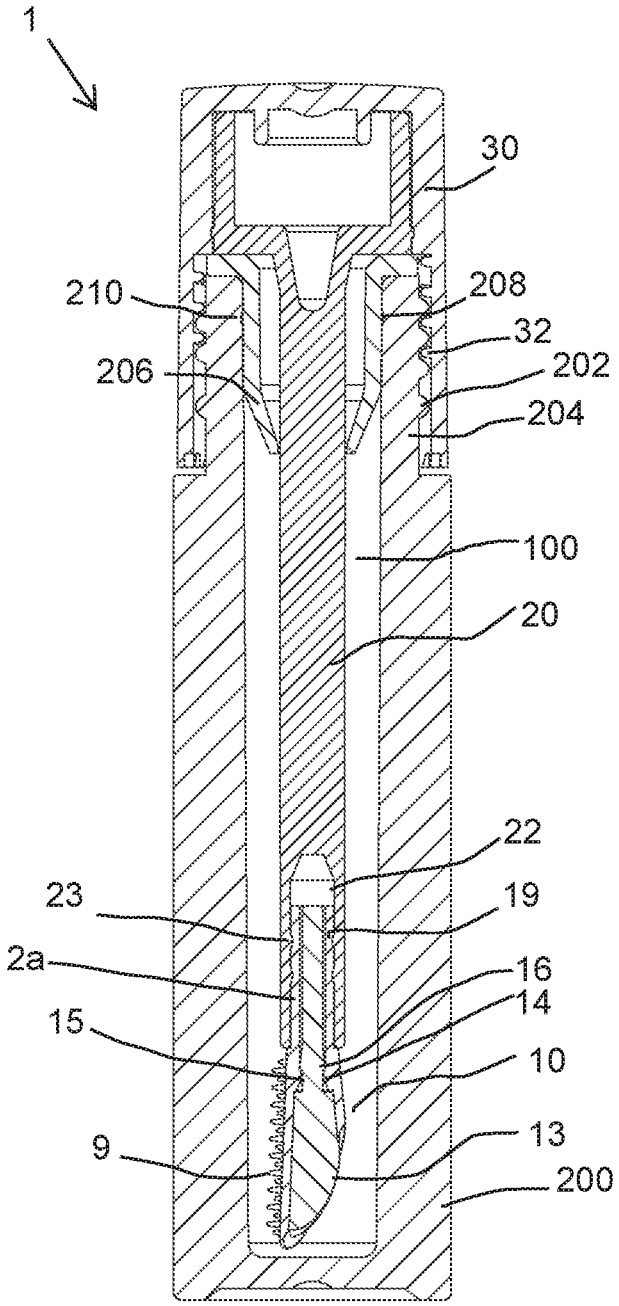
FIG. 1 shows a longitudinal sectional view of a cosmetic package comprising a cosmetic applicator of present disclosure.

To facilitate understanding, identical reference numerals have been used, where possible, to designate identical elements that are common to the figures. It is to be noted, however, that the appended drawings illustrate only typical embodiments of this disclosure and are therefore not to be considered limiting of its scope, for the disclosure may admit to other equally effective embodiments.

DETAILED DESCRIPTION

Throughout this specification, the terms "comprise," "comprises," "comprising" and the like, shall consistently mean that a collection of objects is not limited to those objects specifically recited.

FIG. 1 illustrates a longitudinal sectional view of a cosmetic package 1. The cosmetic package 1 comprises a receptacle 200 for holding a product (not shown) and a cosmetic applicator 100. The cosmetic applicator 100 comprises an applicator head 10 and a cap 30. The cap 30 of the cosmetic applicator 100 has threads 32 which can be screwed onto threads 202, formed on a neck 204 of the receptacle 200.

Inserted in the neck 204 of the receptacle 200 is a wiper 206 for wiping off excess product from the cosmetic applicator 100. The wiper 206 also comprises an annular bead 208 for engaging into a corresponding annular groove 210 on the inside of the neck 204 of the receptacle 200.

The distal end of the stem 20 includes an interior longitudinal cavity 22 for receiving and retaining the applicator head 10.

Figure 2:
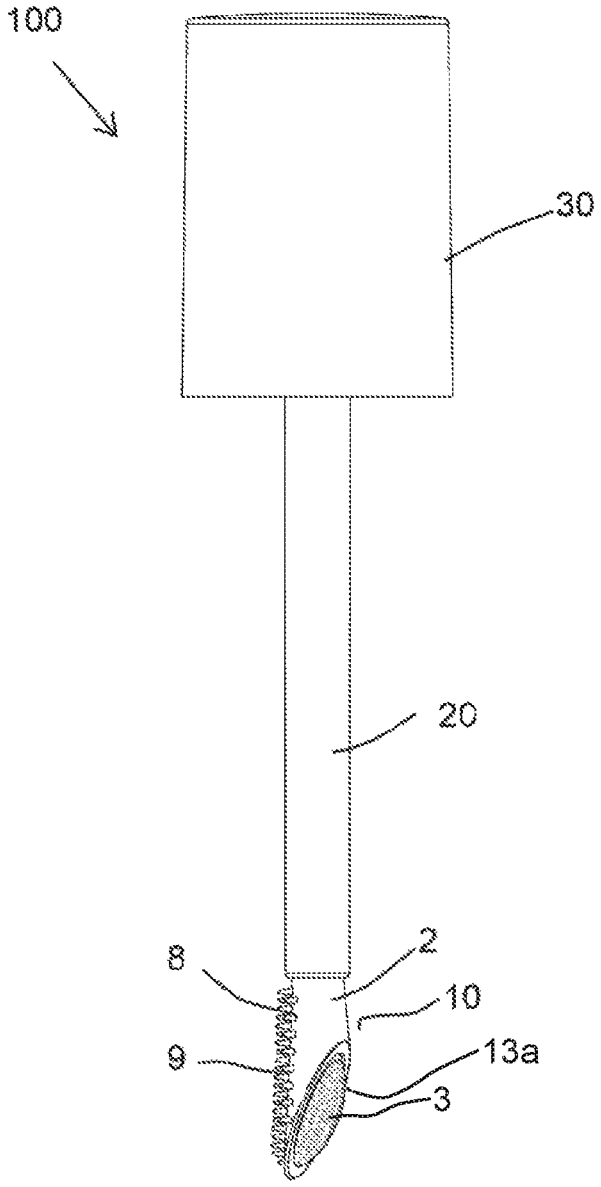
FIG. 2 shows a side view of the cosmetic applicator of FIG. 1.
Figure 3:
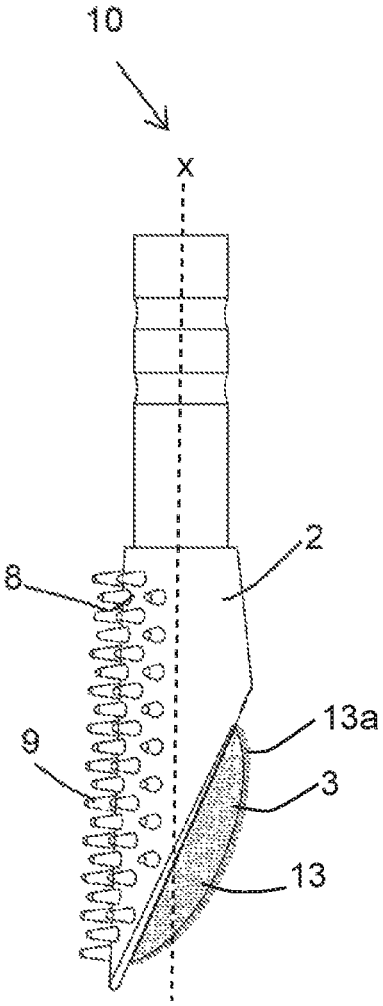
FIG. 3 shows an enlarged side view of an applicator head of FIG. 1.
Figure 4:
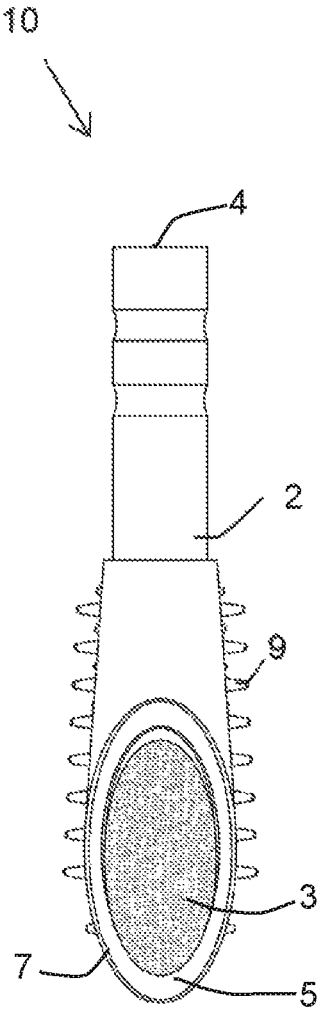
FIG. 4 shows a front view of the applicator head of FIG. 3.
Figure 5:
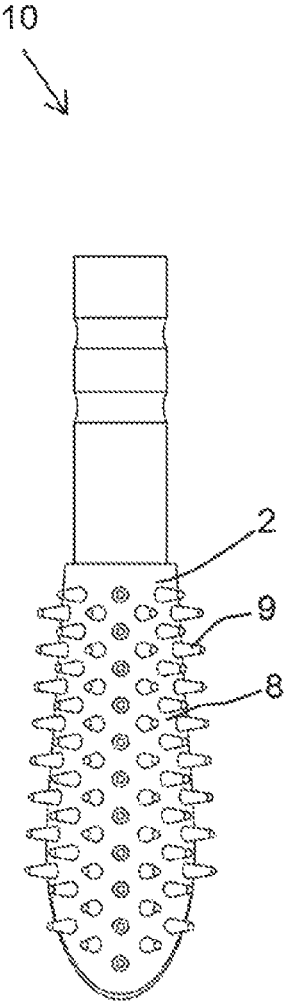
FIG. 5 shows a rear view of the applicator head of FIG. 3.

FIG. 2 illustrates a side view of the cosmetic applicator 100 according to one embodiment of the disclosure. The cosmetic applicator 100 may be used to apply the product (not shown) including a cosmetic or a care product. The cosmetic or care product includes viscous cosmetics, mascara, eyebrow powder, lip gloss, hair color, skin care, under eye cosmetics, pharmaceutical and like products.

As shown in FIG. 2, the cosmetic applicator 100 comprises the applicator head 10 retained at a distal end of a stem 20 for applying the product; and the cap 30 at a proximal end of the stem 20.

As shown in FIGS. 1-4, the applicator head 10 comprises a first applicator member 2 and a second applicator member 3, and wherein a first applicator member 2 is configured to receive and retain at least a portion of the second applicator member 3.

Figure 6:
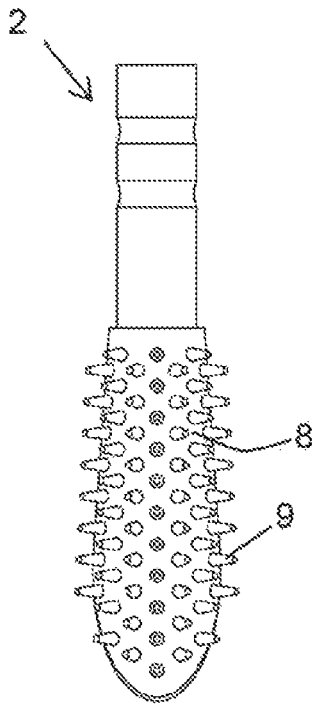
FIG. 6 shows a rear view of a first applicator member of FIG. 3.
Figure 7:
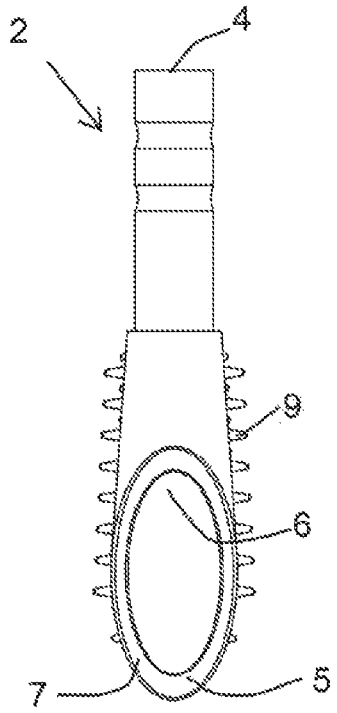
FIG. 7 shows a front view of the first applicator member of FIG. 6.
Figure 8:
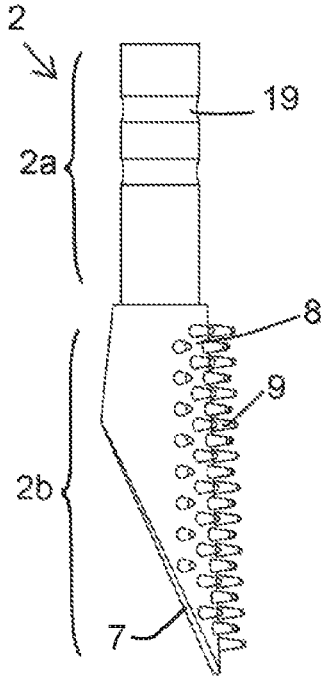
FIG. 8 shows a side view of the first applicator member of FIG. 6.

According to an exemplary embodiment shown in FIGS. 6-8, the first applicator member 2 is substantially cylindrical in shape and comprises a proximal portion 2*a* and a distal portion 2*b*. In alternate embodiments, the first applicator member 2 may be of any other desirable shape.

Figure 12:
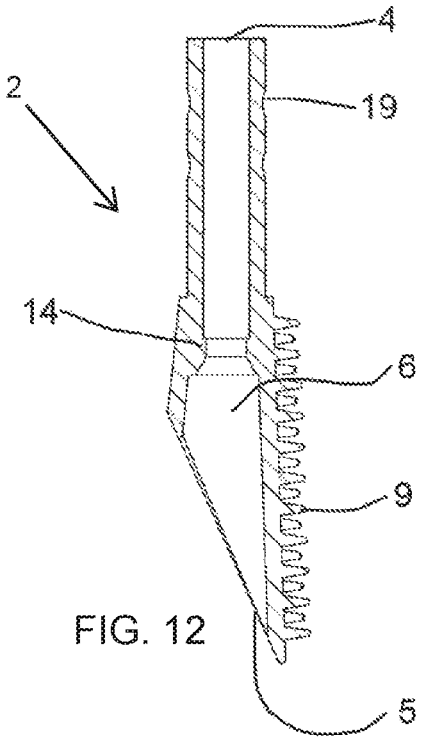
FIG. 12 shows a cross-sectional view of the first applicator member of FIG. 8.
Figure 13:
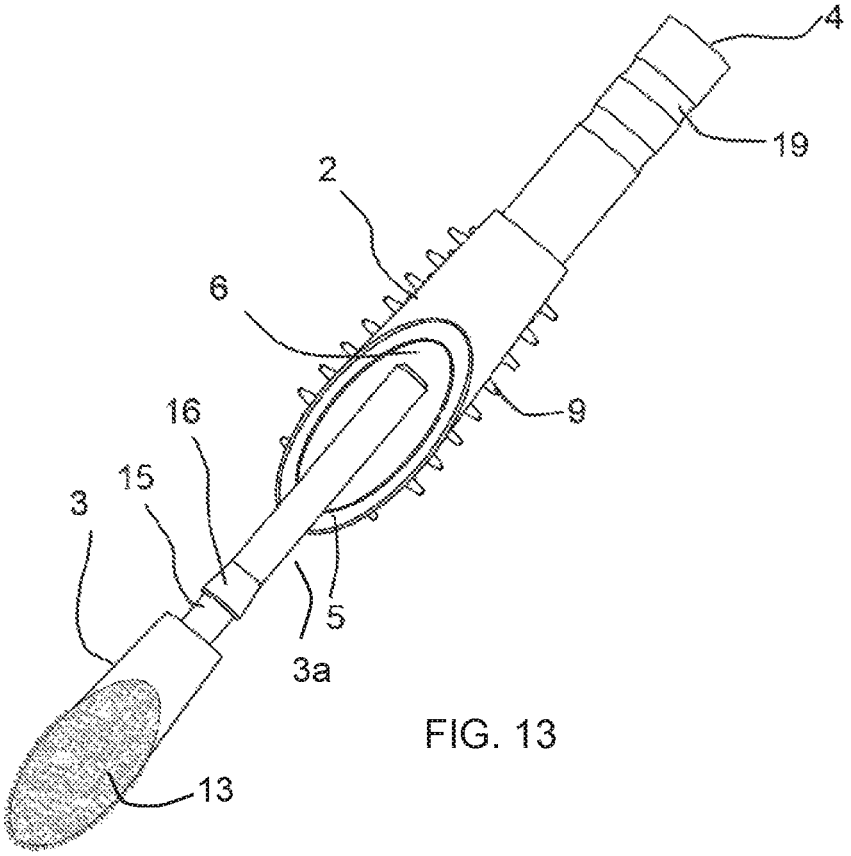
FIG. 13 shows an exploded view of the applicator head of FIG. 3.

According to an aspect of the present embodiment and as seen in FIGS. 12 & 13, the first applicator member 2 has a cavity 6 with an open proximal end 4 and an open distal end 5. The cavity 6 extends throughout a length of the applicator member 2. At least a portion of the second applicator member 3 is received within the cavity 6 of the first applicator member 2.

According to another aspect of the present embodiment and as shown in FIGS. 6-8, the first applicator member 2 has a slanted opening 7 at its distal end 5. More particularly, the cavity 6 of the first applicator member 2 has a substantially oval opening 7 at the distal end 5 of the first applicator member 2. In other words, the opening 7 is oriented in a plane which is oblique with respect to a longitudinal axis X (shown in FIG. 3) of the applicator head 10. In variant embodiments, the opening 7 may have any other desirable shape, spatulate, obovate, elliptic, oblong, deltoid for example.

According to an aspect of the present embodiment and as shown in FIGS. 2-5, at least a portion of an outer surface of the first applicator member 2 defines a first application surface 8 and wherein the first application surface 8 includes a plurality of application elements 9.

According to an aspect of the present embodiment, when the applicator head 10 is withdrawn from the receptacle 200, the wiper 206 cleans the applicator head 10 in a manner such that a minimal amount of product or substantially no product is retained on the plurality of application elements 9 of the first application surface 8. Therefore, a user may use the plurality of application elements 9 of the first application surface 8 for defining human keratinous fibers such as eyebrows or eyelashes.

However, in a variant embodiment, the plurality of application elements is adapted to convey and apply cosmetic product. In present embodiment, the application elements are tines, however in variant embodiments, the application elements may be projections, bristles, tines, flocking, particles, ribs, grooves, discs, slits, cuts, holes, dimples, foam or other surface features or surface treatments (e.g., abrading) that are suitable for combing and/or loading, transporting and applying cosmetic product such as, for example, mascara, eyeshadow etc.

According to an aspect of the present disclosure, the plurality of application elements 9 is spread over at least 40% of an outer surface area of the distal portion 2*b* of the first applicator member 2.

Referring to FIGS. 6 to 8, the proximal portion 2*a* of the first applicator member 2 is formed as shank 2*a* which is configured to be received within the cavity 22 of the stem 20.

According to an embodiment of the present disclosure, a diameter of the shank 2*a* is less than a diameter of the distal portion 2*b* of the first applicator member 2.

Figure 9:
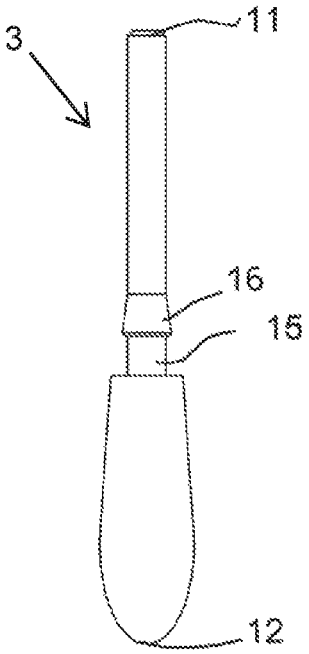
FIG. 9 shows a rear view of a second applicator member of FIG. 3.
Figure 10:
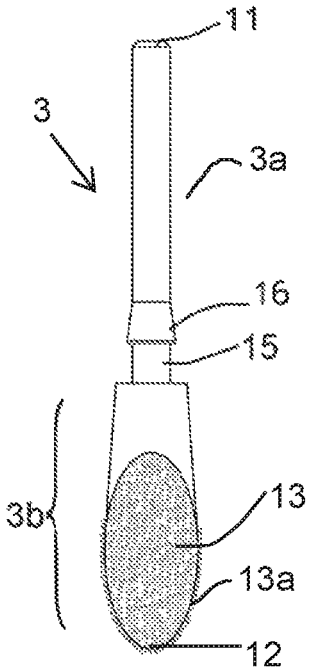
FIG. 10 shows a front view of the second applicator member of FIG. 9.
Figure 11:
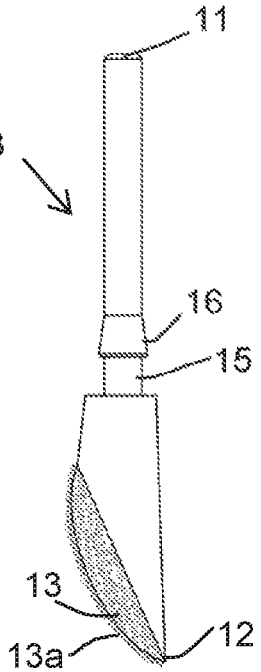
FIG. 11 shows a side view of the second applicator member of FIG. 9.

Referring to FIGS. 9-11, the second applicator member 3 is an elongated rod like structure having a proximal end 11 and a distal end 12. A distal portion 3*b* of the second applicator member 3 includes a slanted distal end surface 13 which is convexly curved, and is configured to apply/spread the product on user's skin. The slanted distal end surface 13 forms a second application surface 13. In use, when the applicator head is withdrawn from the receptacle, the wiper cleans the applicator head in a manner such that an optimal amount of product is retained on the second application surface 13 so that a user may use the second application surface 13 to transfer product to human keratinous fibers.

In an exemplary use of the cosmetic applicator 100 of the present disclosure, the cosmetic applicator 100 may be used for applying a product to eyebrows, and wherein the second application surface 13 may be used for filling and shaping the eyebrows with the product and the applications elements 9 of the first application surface 8 may be used to sculpt and define the eyebrows.

According to yet another aspect of the present embodiment, when the second applicator member 3 is received within the cavity 6 of the first applicator member 2, the second application surface 13 projects or extends out from the opening 7 of the cavity 6 at the distal end of the applicator head 10 or the distal end 5 of the first applicator member 2. In other embodiments not shown in the drawings, the second application surface 13 flushes with the distal end of the first applicator member 2.

Figure 14:
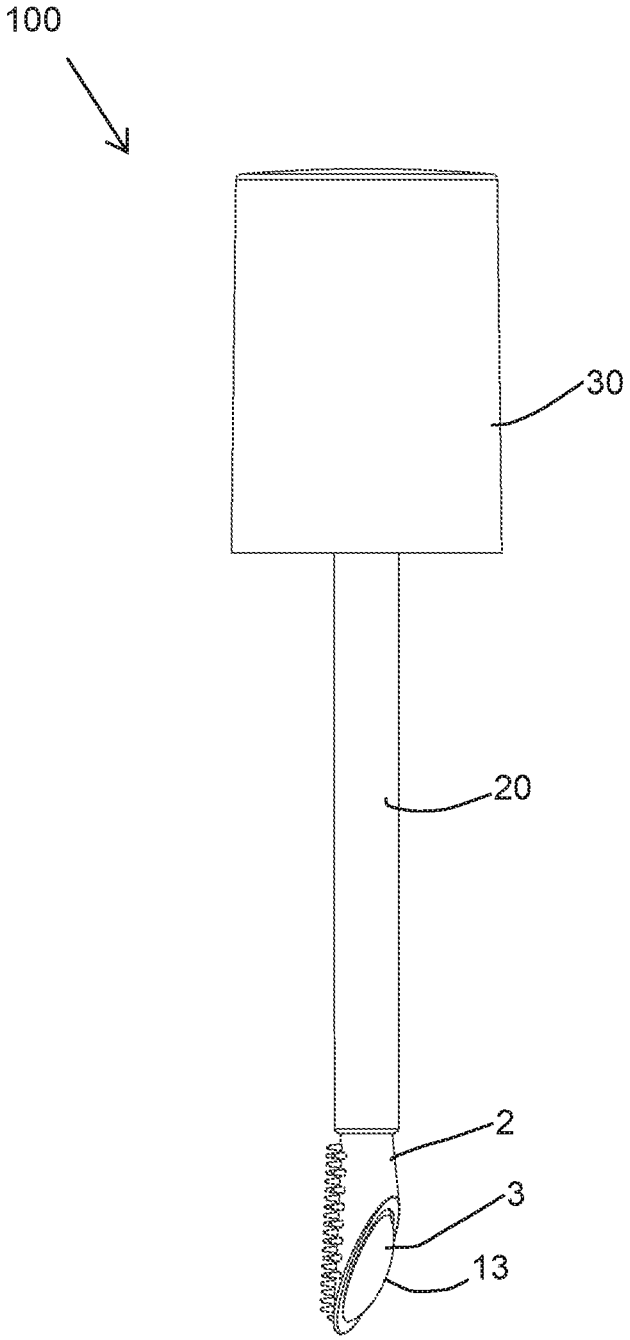
FIG. 14 shows a side view of the cosmetic applicator according to a second embodiment of the present disclosure.

According to yet another aspect of the present embodiment, as seen in FIGS. 2-4, & 10-11, at least a part of the second application surface 13 comprises flocking 13*a*. However, in an alternate embodiment, as shown in FIG. 14 the second application surface 13 of a cosmetic applicator 100 may not be flocked.

According to yet another aspect of the present embodiment, the second application surface 13 may comprise projections, ribs, grooves, other surface features or surface treatments (e.g., abrading) that are suitable for loading, transporting and applying cosmetic product. The second applicator may be made of material capable of retaining a fluid or semi-solid cosmetic product, the material for e.g. may be an absorbent material such as sponge, foam, woven or non-woven material or any porous material including sintered materials.

According to yet another aspect of the present embodiment, the second applicator member 3 can be retained within the cavity 6 of the first applicator member 2, by locking means known in art such as a j-lock, a threaded engagement, an interference engagement, magnetic engagement or the like. In an exemplary embodiment as shown in FIG. 1, the first applicator member 2 and the second applicator member 3 are secured to each other by snap-fitment. Referring to FIGS. 1, 12 & 13, the first applicator member 2 includes an annular projection 14 on its inner surface and the second applicator member 3 includes an annular recess 15 and an annular flange 16 adjacent to said annular recess 15. When the applicator head 10 is assembled, a proximal portion 3*a* of the second applicator member 3 is inserted into the cavity 6 of the first applicator member 2 through the distal end 5 of the first applicator member 2, the annular projection 14 of the first applicator member 2 is snap fitted into the corresponding annular recess 15 of the second applicator member 3, and thus further insertion of the second applicator member 3 with respect to the first applicator member 2 is limited. Further, the flange 16 of the second applicator member 3 is locked against the annular projection 14 making removal of the second applicator member 3 difficult.

In an alternate embodiment, the annular projection 14 may be on the second applicator member 3 in which case, the annular recess 15 is on the first applicator member 2.

According to an aspect of the present disclosure, there are provided complimentary orientation features on the inner surface of the first applicator member 2 and outer surface of the second applicator member 3 to orient the second applicator member 3 with respect to the first applicator member 2 in a predetermined desirable position. Preferably, the second applicator member 3 is so oriented that an apex of the second applicator member 3 is always in line with an apex of the first applicator member 2.

Figure 15:
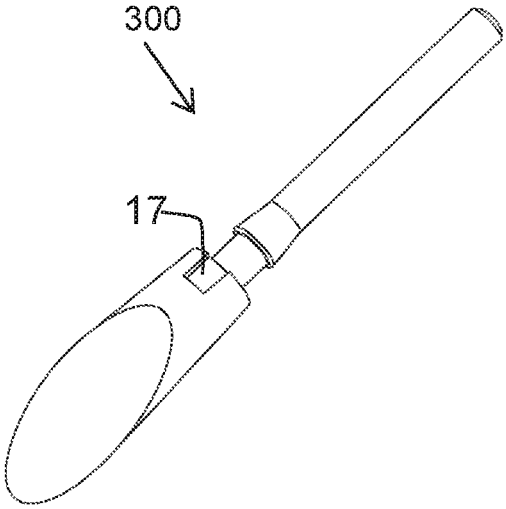
FIG. 15 shows an enlarged perspective view of a second applicator member of FIG. 14.
Figure 16:
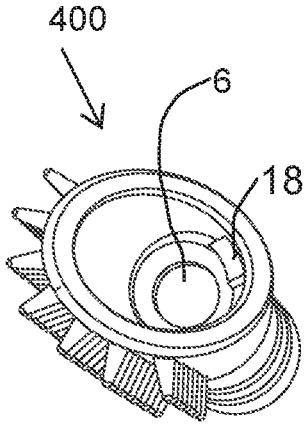
FIG. 16 shows an enlarged bottom view of a first applicator member of FIG. 14.
Figure 17:
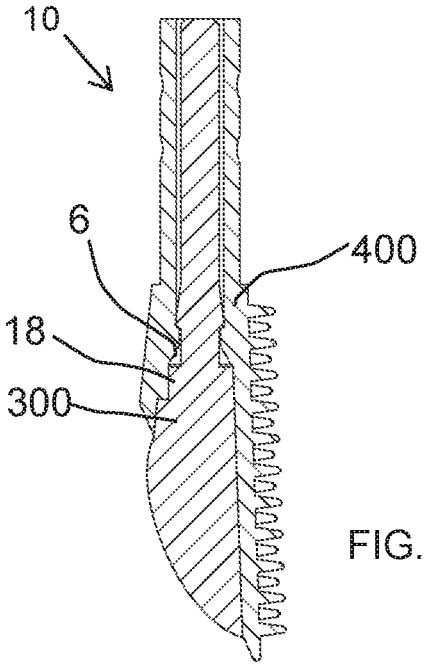
FIG. 17 shows an enlarged cross sectional view of an applicator head of FIG. 14.

According to an alternate embodiment of the present disclosure, as shown in FIGS. 15-17, an orientation feature such as a longitudinal groove 17 is provided on an outer surface of a second applicator member 300 and a complimentary orientation feature which is a longitudinal protrusion 18 is provided on an inner surface inside the cavity 6 of the first applicator member 400. When the second applicator member 300 is inserted into the cavity 6 of the first applicator member 400, the protrusion 18 fits into the longitudinal groove 17 so as to align the first applicator member 400 and the second applicator member 300 in a predetermined desirable position. Preferably, the second applicator member 300 is so oriented that an apex of the second applicator member 300 is always in line with an apex of the first applicator member 400. In yet another alternate embodiment, the longitudinal groove 17 may be present on the inner surface of the first applicator member 400 and the longitudinal protrusion 18 may be present on the outer surface of the second applicator member 300.

The applicator head 10 and the stem 20 may be fit together by friction fit, snap fit, by gluing, crimping, magnetic engagement and the like. In an exemplary embodiment as shown in FIG. 1, the application head 10 and the stem 20 are fitted together by snap fitment. The shank 3*a* of the first applicator member 2 includes at least one annular recess 19 and the inner surface of the stem cavity 22 includes corresponding annular bead 23. When the proximal portion/shank 2*a* of the applicator head 10 is inserted into the interior longitudinal cavity 22 of the stem 20, the at least one annular bead 23 is snap-fitted into a corresponding annular recess 19.

According to an alternate embodiment of the present disclosure, at least a portion of one of the first application surface 8 and the second application surface 13 are covered by a flock coating.

According to an alternate embodiment of the present disclosure, at least one of the application elements 9 is covered by a flock coating.

According to an embodiment of the present disclosure, material used for making the applicator head 10 can be selected from a group consisting of plastic, metal, alloy, ceramic, stone, wood, rubber, absorbent materials and the like.

According to an embodiment of the present disclosure, the first applicator member 2, 400 is fabricated from a material selected from a group consisting of plastic, metal, alloy, ceramic, stone, wood, rubber, sintered or porous material and/or combinations thereof.

According to an embodiment of the present disclosure, the second applicator member 3, 300 is fabricated from a material selected from a group consisting of plastic, metal, alloy, ceramic, stone, wood, rubber, sintered or porous material and/or combinations thereof.

It will be understood that the foregoing is only illustrative of the principles of the disclosure, and that various modifications can be made by those skilled in the art without departing from the scope and spirit of the disclosure. For example, the shapes and/or sizes of various components can be different from the shapes and sizes shown herein. As another example, the materials used for various components can be different from those mentioned specifically herein.

What is claimed is:

1. A cosmetic applicator for applying a product including a cosmetic or a care product, comprising:

an applicator head retained at a distal end of a stem and a cap at a proximal end of the stem;

wherein the applicator head comprises a first applicator member and a second applicator member;

wherein the first applicator member is cylindrical in shape and has a cavity extending throughout a length of the first applicator member;

wherein the cavity has an opening at a distal end of the first applicator member;

wherein the second applicator member is an elongated rod like structure and at least a portion of the second applicator member is received within the cavity of the first applicator member;

wherein a portion of an outer surface of the first applicator member includes a first application surface having a plurality of application elements;

wherein a distal end surface of the second applicator member includes a second application surface; and wherein the distal end surface of the second applicator member is a single, continuous surface that substantially spans the opening and is in a fixed position relative to the first applicator member and to the opening.

2. A cosmetic applicator according to claim 1, wherein the opening has a shape selected from a group consisting of oval, spatulate, obovate, elliptic, oblong and deltoid.

3. A cosmetic applicator according to claim 1, wherein the opening is oriented in a plane which is oblique with respect to a longitudinal axis of the applicator head.

4. A cosmetic applicator according to claim 1, wherein the distal end surface of the second applicator member is slanted with respect to a longitudinal axis of the applicator head.

5. A cosmetic applicator according to claim 1, wherein the distal end surface of the second applicator member is convexly curved.

6. A cosmetic applicator according to claim 1, wherein the plurality of application elements are selected from projections, bristles, tines, flocking, particles, ribs, grooves, discs, slits, cuts, holes, dimples and foam.

7. A cosmetic applicator according to claim 1, wherein the first applicator member and the second applicator member are molded applicator members.

8. A cosmetic applicator according to claim 1, wherein at least a part of the second application surface comprises flocking, projections, ribs or grooves.

9. A cosmetic applicator according to claim 1, wherein each of the first applicator member and the second applicator member is fabricated from a material selected from a group consisting of plastic, metal, alloy, ceramic, stone, wood, rubber, sintered, porous material and combinations thereof.

10. A cosmetic applicator according to claim 1, wherein the second application surface projects out from the opening of the cavity at the distal end of the first applicator member.

11. A cosmetic applicator according to claim 1, wherein the second application surface flushes with the distal end of the first applicator member.

12. A cosmetic applicator for applying a product including a cosmetic or a care product, comprising an applicator head:

wherein the applicator head comprises a first applicator member and a second applicator member;

wherein the first applicator member is cylindrical in shape and has a cavity extending throughout a length of the first applicator member;

wherein the cavity has an opening at a distal end of the first applicator member;

wherein at least a portion of the second applicator member is received within the cavity of the first applicator member;

wherein a portion of an outer surface of the first applicator member includes a first application surface having a plurality of application elements;

wherein a distal end surface of the second applicator member includes a second application surface; and wherein the distal end surface of the second applicator member is a single, continuous surface that substantially spans the opening and is in a fixed position relative to the first applicator member and to the opening.

13. A cosmetic applicator according to claim 12, wherein the second application surface projects out from the opening of the cavity at the distal end of the first applicator member.

14. A cosmetic applicator according to claim 12, wherein the second application surface flushes with the distal end of the first applicator member.

15. A cosmetic applicator according to claim 12, wherein the first applicator member includes an annular projection on its inner surface and the second applicator member includes an annular recess on its outer surface and an annular flange adjacent to said annular recess; or wherein the first applicator member includes an annular recess on its inner surface and the second applicator member includes an annular projection on its outer surface and an annular flange adjacent to said annular recess.

16. A cosmetic applicator according to claim 12, wherein a longitudinal groove is provided on an outer surface of a second applicator member and a complimentary longitudinal protrusion is provided on an inner surface inside the cavity of the first applicator member.

17. A cosmetic applicator according to claim 12, wherein the opening has a shape selected from a group consisting of oval, spatulate, obovate, elliptic, oblong and deltoid.

18. A cosmetic applicator according to claim 12, wherein the opening is oriented in a plane which is oblique with respect to a longitudinal axis of the applicator head.

19. A cosmetic applicator according to claim 12, wherein the distal end surface of the second applicator member is slanted with respect to a longitudinal axis of the applicator head.

20. A cosmetic applicator for applying a product including a cosmetic or a care product, comprising an applicator head:

wherein the applicator head comprises a first applicator member and a second applicator member;

wherein the first applicator member is cylindrical in shape and has a cavity extending throughout a length of the first applicator member;

wherein the cavity has an opening at a distal end of the first applicator member;

wherein at least a portion of the second applicator member is received within the cavity of the first applicator member;

wherein a portion of an outer surface of the first applicator member includes a first application surface having a plurality of application elements;

wherein a distal end surface of the second applicator member includes a second application surface;

wherein a distal tip of the second applicator member is adjacent to a distal-most edge of the opening of the first applicator member; and wherein the distal end surface of the second applicator member is a single, continuous surface that substantially spans the opening and is in a fixed position relative to the first applicator member and to the opening.

* * * * *